United States Patent [19]

Kaplan

[11] Patent Number: 4,537,032

[45] Date of Patent: Aug. 27, 1985

[54] PARALLEL-STAGE MODULAR RANKINE CYCLE TURBINE WITH IMPROVED CONTROL

[75] Inventor: Uri Kaplan, Rehovot, Israel

[73] Assignee: Ormat Turbines (1965) Ltd., Yavne, Israel

[21] Appl. No.: 486,498

[22] Filed: Apr. 19, 1983

[51] Int. Cl.[3] ..... F01K 13/02

[52] U.S. Cl. ..... 60/662; 60/719

[58] Field of Search ..... 60/662, 651, 671, 670, 60/719

[56] References Cited

U.S. PATENT DOCUMENTS 992,566 5/1911 Kemble .

3,391,539 7/1968 Dimitroff, Jr. et al. ..... 60/662

*Primary Examiner*—Allen M. Ostrager

*Attorney, Agent, or Firm*—Sandler & Greenblum

[57] ABSTRACT

The turbine of a Rankine cycle power plant has a plurality of modular units constituting a turbine to which vaporized working fluid from a boiler is supplied in parallel through respective adjustable throttle valves. Exhaust vapor is removed from the modular units in parallel; and the load on the turbine is controlled by controlling the operation of each throttle valve such that, under any load condition, only one throttle valve at a time is adjusted and all of the others are either fully open or fully closed.

6 Claims, 5 Drawing Figures

PARALLEL-STAGE MODULAR RANKINE CYCLE TURBINE WITH IMPROVED CONTROL

DESCRIPTION

1. Technical Field

This invention relates to a multistage modular Rankine cycle turbine with improved control for variable load conditions.

2. Background Art

U.S. Pat. No. 992,566 discloses a steam turbine having a high pressure stage and a number of low pressure stages each of which is supplied, in parallel, with steam exhausted from the high pressure stage. According to the patentee, higher loads can be accomodated without changing the radial and circumferential dimensions of the low pressure stages, each of which is identical, by increasing within limits, the number of such stages. Each stage of the turbine is provided with many nozzles that can be connected selectively to a heat source thereby providing very fine incrementation of the work output of the turbine.

The design shown in the '566 patent is not suitable for use with a power plant operating on low grade heat because the working fluid in this patent is water. When only low grade heat is available, the size of a steam turbine becomes so large as to be impractical. The problem of turbine size, when a low grade is available, is solved by utilizing a high molecular weight organic fluid, as the working fluid. Turbines operating on the Rankine cycle using organic working fluids are coamercially available from Ormat Turbines Ltd., and are hereafter referred to as power plants of the type described. They are available in sizes ranging from 300–3000 kW and are conventionally use to power repeater stations as part of a telecommunication network and for other relatively low power requirements where high reliability in both start-up and operation is a mandatory.

Rankine cycle turbogenerators operating with organic working fluids are ideally suitable for use with low grade heat sources such as waste heat, geothermal sources, and solar ponds. Typically, a waste heat or solar pond installation may require from 0.75 MW to 5 MW of electrical power. But scaling-up conventional power plants of the type described by three or more orders of magnitude to accomodate this substantial amount of power is difficult.

One approach to the design of Rankine cycle turbogenerator of the type described is merely to scale up the turbine and to multistage much as is done in conventional steam turbines. In such case, the exhaust of one turbine stage becomes the input to a succeeding turbine stage. Unfortunately, conventional multistaging of organic fluid results in a physically large and hence impractical low pressure turbine.

It is therefore an object for the present invention to provide a new and improved multistage, modular Rankine cycle turbine and means for controlling the same which permits economical construction of relatively large capacity organic fluid turbogenerators and their economical use.

BRIEF DESCRIPTION OF THE INVENTION

The method according to the present invention controls the load on a turbine of a Rankine cycle power plant wherein the turbine has a plurality of a modular units to which vaporized working fluid from a boiler is supplied in parallel through respective throttle valves, and from which exhaust vapor is removed in parallel. The method according to the present invention comprises controlling the operation of each throttle valve such that, under any load condition, only one throttle valve at a time is particularly open and adjustable, and all of the others are either fully open or fully closed. When the turbine is called upon to produce more work than can be supplied by single modular unit, the throttle valve of the single unit is adjusted while the throttle valve of the other units remain fully closed until the throttle valve of the single unit is fully open. Thereafter, the throttle valve of an other unit is opened and adjusted while the throttle valve of the one unit remains fully open. The converse of this arrangement is achieved when the turbine is called upon to produce less work than can be produced by two modular units.

BRIEF DESCRIPTION OF DRAWINGS

An embodiment of the invention is shown in the accompanying drawings wherein.

DETAILED DESCRIPTION

Figure 1:
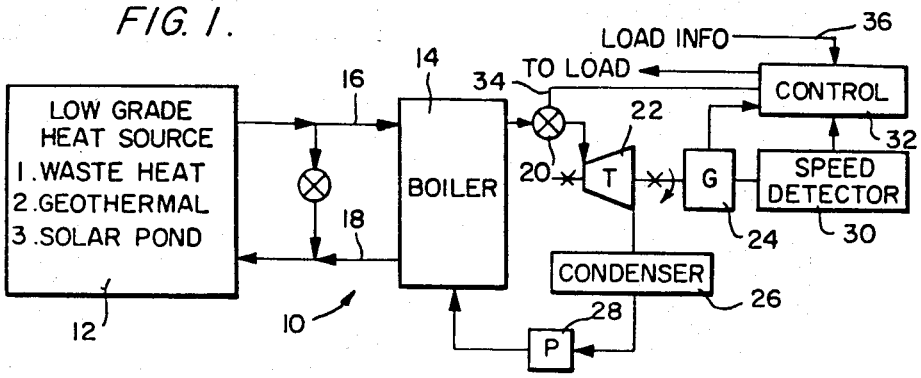
FIG. 1 is a block diagram of a conventional Rankine cycle power plant.

Referring now to the drawings, reference numeral 10 designates a conventional Rankine cycle power plant operating from low grade heat source 12 such as waste heat, geothermal source or solar pond. Fluid from heat source 12, typically at a temperature less than 100 deg. C., enters boiler 14 via inlet line 16, gives-up some of its heat to the working fluid in the boiler, and then is returned via exit line 18 to source 12. The working fluid in boiler 14 is an organic working fluid, typically Freon. In boiler 14, the working fluid is vaporized and applied through throttle valve 20 to Rankine cycle turbine 22 wherein the working fluid expands causing the turbine to rotate and produce work that drives generator 24 which produces electricity.

After expansion in turbine 22, the working fluid at a lower temperature and pressure is directed into condenser 26 which condenses the working fluid into a liquid. The condensate is returned by pump 28 to boiler 14 thus completing the working fluid cycle.

To provide speed control for the turbine, the rotational speed of the turbine and generator (turbogenerator), typically mounted on a common shaft or on two shafts that are coupled together for rotation at the same speed is detected by detector 30 in a conventional manner. The output of speed detector 30 is applied to a control 32 which senses an overspeed or underspeed condition of the turbogenerator and responds by applying a control signal via lead 34 to throttle valve 20 for the purpose of correcting the over or underspeed condition. Control 32 may also receive, via control line 36, information on the load requirements in order to effectively provide the power plant with the neccessary controls for responding to load conditions.

The size of a low grade heat source varies from installation to installation from a fraction of a megawatt to tens of megawatts so that it is very difficult for a manufacturer of power plants to establish a variety of standard sizes wide enough to satisfy many different, potential customers of power plants seeking to take advantage of low grade heat sources. Therefore, it is convenient, in terms of economy of size of components, and the manufacture, handling and flexibility in design, installation and maintenance, to construct power plants in the type described in modules, typically 1.25 MW. Thus, a 5 MW power plant would require four turbine modules which would be connected by a single output shaft to a single generator in order to produce the required power. Each turbine module is mounted on a common shaft contained within a single housing. This arrangement is shown in FIG. 2 to which reference is now made.

Figure 2:
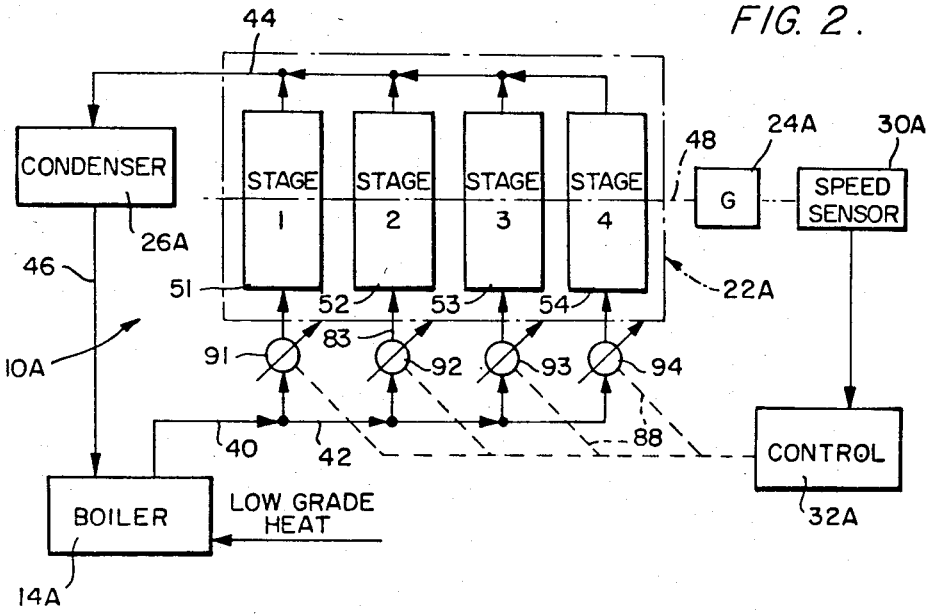
FIG. 2 is a schematic block diagram of a Rankine cycle turbogenerator showing control means for controlling the operation of the various throttle valves associated with the power plant.

In FIG. 2, an organic working fluid Rankine cycle power plant 1OA, according to the present invention includes boiler 14A that delivers vaporized working fluid via inlet pipe 40 to inlet manifold 42 connected to turbine 22 A. Power plant 1OA also includes condenser 26A that receives working fluid from exhaust manifold 44 connected to turbine 22A and produces condensate that is returned via line 46 to boiler 48. Output shaft 48 of the turbine is connected to generator 24A which is suitability connected (not shown) to an electrical load. Speed sensor 32A senses the rotation speed of the turbogenerator and sends this information to control 38 which functions has described above to control the turbine speed.

Figure 3:
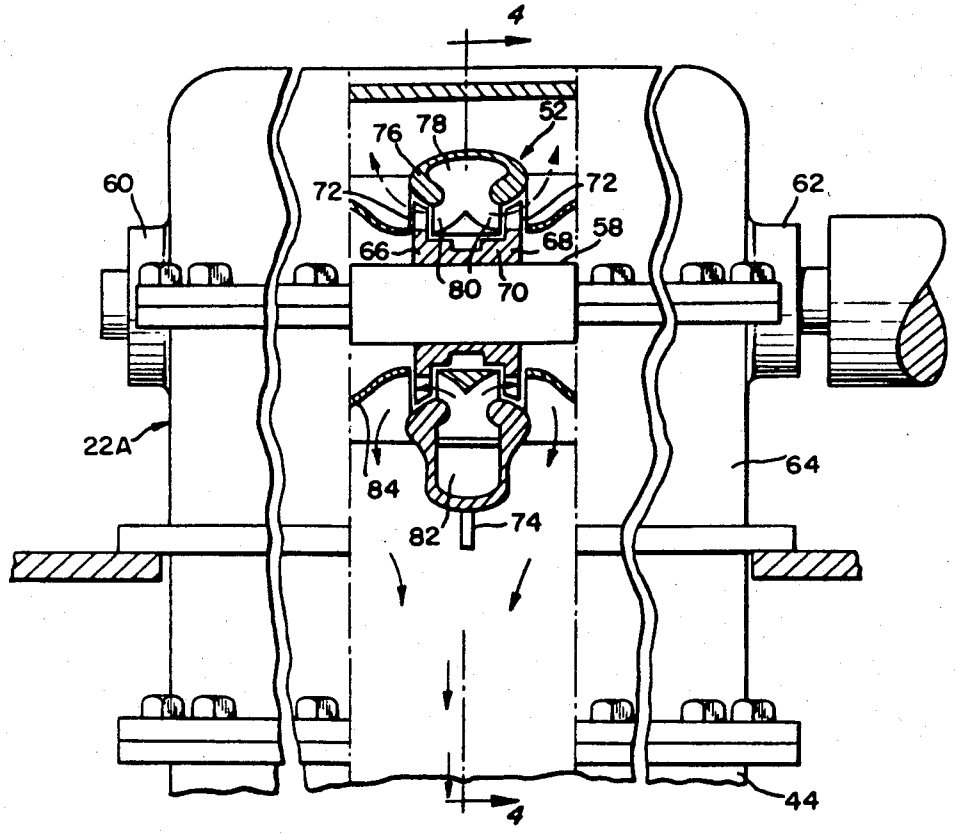
FIG. 3 is a side view of the turbine unit with parts broken away and shown in section for the purpose of illustrating the constructional details of a modular unit of the turbine, according to the present invention.

Turbine 22A comprises a polarity of modular stages 51, 52, 53, 54, each of which is constructed in accordance with the details shown in FIG. 3. As shown therein, each modular unit has at least one axial flow stage, and preferably two axial stages.

Turbine 22A, as shown in FIG. 3, includes turbine shaft 58 rotatively mounted in bearings 60 and 62 located at the axial ends of housing 64 of the turbine. Mounted on shaft 58 are a plurality of modular units, such as units 51, 52, 53, 54 shown in FIG. 2. To facilitate the description, stage 52 is shown in FIG. 3. All of the other stages are identical so that the description of modular unit 52 will suffice for an understanding of the present invention.

Modular unit 52 has a pair of axially spaced discs 66, 68 and coupled together by hub 70 which is fixed to shaft 58 for rotation therewith. Each of discs 66 and 68 have a plurality of axial flow turbine blades 72 on the periphery of each disc. The blades on the discs of each unit are arranged in axial-counter-flow fashion so that the flow of working fluid through one set of blades is in an axial direction opposite to the axial direction in which flow through the other set of blades occurs. Fixed to housing 64 by support 74 is nozzle ring 76 defining annular chamber 78 that is fixed in the axial space between discs 66 and 68. Ring 76 is provided with a plurality of nozzles 80 that are directed axially in opposite directions from a central plane bisecting the planes of blades 72 on the discs. The nozzles are connected by annular region 82 so that working fluid entering inlet portion 84 (see FIG. 4) can flow within annular region 82, in spiral fashion, and can enter each of nozzles 80 which are distributed circumferentially.

Fixed within housing 64 of the turbine are exhaust deflectors 84 located in the space between adjacent modular units. These deflectors are rigidly attached to housing 64 and served to direct the working vapor exhausted by the turbine modules into a central plenum chamber within the housing forming exhaust manifold 44.

Figure 4:
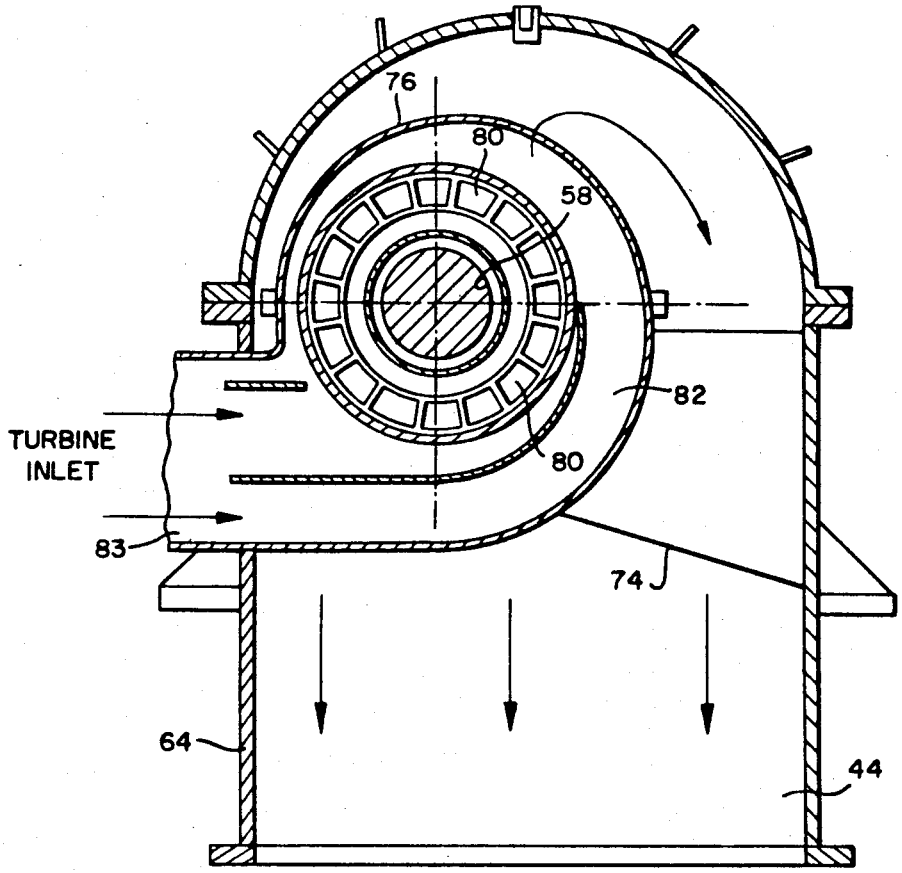
FIG. 4 is a vertical section through the turbine taken along the lines 4—4 of FIG. 3.

In operation, working fluid enters inlet 83, flows spirally through annular region 82 shown in FIG. 4, and enters nozzles 80 which are distributed circumferentially with respect to the turbine blades. Half of the fluid is distributed in one axial direction and passes through and interacts with the blades of one disc, and the other half of the fluid passes the opposite axial direction and interacts with the blades of the other disc. Deflectors 84 serves to direct the working fluid exhausted from the blades into chamber 44 which acts as an exhaust manifold as described previously.

Returning now to FIG. 2, each inlet 83 of the modular units is connected to individual throttle valve 91–94 by which the modular units are connected to inlet manifold 42. Each throttle valve 86 is separately controleable by control 32 as indicated by control lines 88 in FIG. 2. This arrangement is provided so that under partial load conditions, the vapor supplied by the boiler undergoes the least possible amount of throttling, thus optimizing the efficiency of turbine 22A. Each valve is actuated in a conventional manner by an electrical signal or hydraulic signal supplied by control 32 in accordance with the speed of shaft 88 as sensed by sensor 30A.

Figure 5:
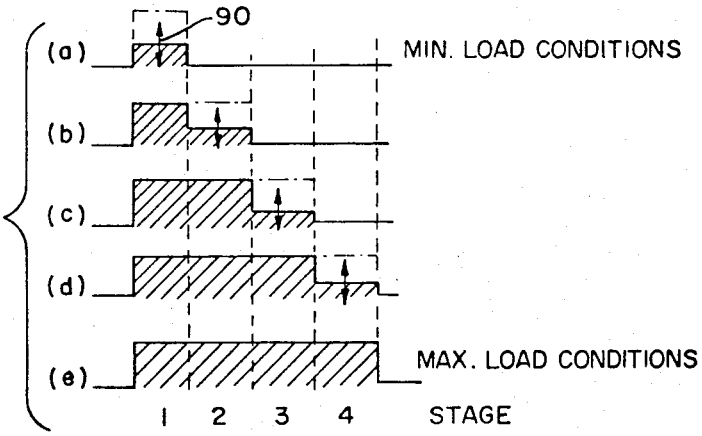
FIG. 5 is a chart that illustrates the manner in which the turbine is controlled by individually controlling the throttling of each stage.

Control 32A operates valve in a manner illustrated in FIG. 5. That is to say, control 32A controls the operation of each valve 91–94 such that, under any load condition, only one throttle valve at a time is adjusted and all of the others are either fully open of fully closed. Under minimum load conditions, which is a situation when turbine 22A is being started, each of valve 92, associated with unit 52, valve 93 associated with unit 53 and valve 94 associated with unit 54 is closed; and only valve 91 associated with unit 51 is open and adjusted by control 32A. This is shown in upper line (a) of FIG. 5 where the ordinant represents the degree to which valve 91 is open. The cross-sectional area shown in FIG. 5 represents the load being furnished by the stage. Thus, as shown in line (a) of FIG. 5, unit 51 furnishes only a portion of the possible load (chain lines) it can supply. Control 32A operates to increase the load on the turbine and this control is shown by arrow 90.

Control 32A continues to open valve 91 until, it is fully open. This is illustrated in line (b) where control 32A becomes effective to begin to open valve 92 as valves 93 and 94 remain closed, valve 91 remaining fully open. Control 32 continues to open valve 92 until unit 52 is producing all the power it can and valve 92 is fully open. When this occurs, as shown in line (c), valve 93 is opened and adjusted by control 32A as valves 91 and 92 remain fully open and valve 94 remains fully closed. The situtation is repeated as shown in line (d) until valve 93 is fully opened and adjusted by control 32A while valves 91, 92 and 93 remain fully open.

When generator 24A is other than a synchronous generator connected to an electrical grid, control 32A provides whatever control is necessary for the speed of turbine 22A by following the procedure shown in FIG. 5. That is to say, speed-up or slow-down of the turbine is achieved by adjusting only one throttle valve at a time while the other throttle valves remain either fully open or fully closed depending upon load conditions.

What is claimed is:

1. A method for controlling the load on a Rankine cycle power plant comprising a plurality of modular turbine units to which vaporized working fluid from a boiler is supplied in parallel through respective throttle valves, and from which exhausted vapor is removed in parallel, said method comprising the step of controlling the operation of each throttle valve such that under any load condition, only one throttle valve at a time is variable and all of the other valves are either fully open or fully closed.

2. A method according to claim 1 wherein work produced by the power plant is increased beyond the capacity of a single modular turbine unit by opening the throttle valve of the single unit while maintaining the throttle valve of the other unit fully closed until the throttle valve of the single is fully open and therafter partially opening the throttle valve of the another unit.

3. A method according to claim 2 wherein work produced by the power plant is decreased below the capacity of two modular units by closing the throttle valve of one of the two modular units while maintaining the throttle valve of the other unit fully open until the valve of the one unit is fully closed, and thereafter partially closing the valve of the other unit.

4. A turbine and control therefor for use in an organic working fluid Rankine cycle power plant of the type having a boiler that delivers vaporized working fluid to an inlet manifold connected to the turbine, and a condenser that receives working fluid from an exhaust manifold connected to the turbine and produces condensate that is returned to the boiler, the turbine and control therefore comprising:

(a) a plurality of modular turbine units each of which has at least one axial flow stage, a nozzle ring for directing vaporized working fluid into said at least one axial flow stage wherein the working fluid expands and produces work, and an exhaust ring for receiving expanded working fluid exhausted from said at least one stage;

(b) means mounting the modular units on a common shaft for coupling to an electrical generator;

(c) a throttle valve operatively associated with each modular unit and connected to the nozzle ring thereof for effecting a parallel connection to said inlet manifold;

(d) means for effecting a parallel connection of the exhaust rings of the units to said exhaust manifold; and (e) control means for controlling the operation of each throttle valve such that, under any load condition, only one throttle valve at a time is adjustable and all of the others are either fully open or fully closed.

5. A turbine and control therefor according to claim 4 wherein each of said modular turbine units has, in addition to said at least one axial flow stage, another axial flow stage integral with said at least one axial stage but oriented in counterflow relationship thereto, and the nozzle ring of each of said modular units is centrally located between two axial flow stages.

6. A turbine and control therefor according to claim 5 wherein the exhaust ring of each of said modular units includes a deflector.

* * * * *